US005990405A

United States Patent [19]

Auten et al.

[11] Patent Number: 5,990,405

[45] Date of Patent: Nov. 23, 1999

[54] SYSTEM AND METHOD FOR GENERATING AND CONTROLLING A SIMULATED MUSICAL CONCERT EXPERIENCE

[75] Inventors: Don R. Auten, Nashville; Richard T. Akers, Antioch; Richard Gembar, Mt. Juliet, all of Tenn.

[73] Assignee: Gibson Guitar Corp., Nashville, Tenn.

[21] Appl. No.: 09/112,050

[22] Filed: Jul. 8, 1998

[51] Int. Cl.[6] ..... G10H 1/36

[52] U.S. Cl. ..... 84/609; 84/610; 84/634; 84/649; 84/650

[58] Field of Search ..... 84/600–602, 609–612, 84/622–625, 626, 633–636, 649–652, 712–714, 477 R, 478

[56] References Cited

U.S. PATENT DOCUMENTS

| | | | |
|---|---|---|---|
| 3,490,328 | 1/1970 | King | 84/169 |
| 3,609,019 | 9/1971 | Tuber | 352/17 |
| 3,617,647 | 11/1971 | Maler et al. | 179/100 |
| 3,900,886 | 8/1975 | Coyle, et al. | 358/82 |
| 4,081,829 | 3/1978 | Brown | 358/82 |
| 4,182,214 | 1/1980 | Wakeman | 84/1.28 |
| 4,257,062 | 3/1981 | Meredith | 358/81 |
| 4,267,561 | 5/1981 | Karpinsky, et al. | 358/82 |
| 4,768,086 | 8/1988 | Paist | 358/81 |
| 4,988,981 | 1/1991 | Zimmerman | 340/709 |
| 5,148,154 | 9/1992 | MacKay, et al. | 340/712 |
| 5,307,456 | 4/1994 | MacKay | 395/154 |
| 5,319,452 | 6/1994 | Funahashi | 348/6 |
| 5,355,762 | 10/1994 | Tabata | 84/609 |
| 5,393,926 | 2/1995 | Johnson | 84/610 |
| 5,513,129 | 4/1996 | Bolas et al. | 364/578 |
| 5,670,729 | 9/1997 | Miller, et al. | 84/609 |
| 5,773,742 | 6/1998 | Eventoff et al. | 84/609 |

*Primary Examiner*—William M. Shoop, Jr.
*Assistant Examiner*—Marlon Fletcher
*Attorney, Agent, or Firm*—Waddey & Patterson

[57] ABSTRACT

A musician can simulate participation in a concert by playing a musical instrument and wearing a head-mounted 3D display that includes stereo speakers. Audio and video portions of a musical concert are pre-recorded, along with a separate sound track corresponding to the musical instrument played by the musician. Playback of the instrument sound track is controlled by signals generated in the musical instrument and transmitted to a system interface box connected to the audio-video play back device, an audio mixer, and the head-mounted display. An external bypass switch allows the musician to suppress the instrument sound track so that the sounds created by actual playing of the musical instrument are heard along with the pre-recorded audio and video portions.

30 Claims, 2 Drawing Sheets

SYSTEM AND METHOD FOR GENERATING AND CONTROLLING A SIMULATED MUSICAL CONCERT EXPERIENCE

BACKGROUND OF THE INVENTION

The present invention relates generally to audio and video simulations of a pre-recorded musical performance.

More particularly, this invention pertains to the generation and control of a simulated musical concert experience and participation by a musician in a pre-recorded musical performance using a musical instrument as the control device.

Virtual reality systems are generally recognized to be a combination of computer hardware, software, and peripherals which recreate a virtual world or virtual environment using a video display, often in combination with an audio sound system. Conventional virtual reality systems are quite complex, combining the hardware, software, and peripheral devices in a specific manner to immerse or subject the user of the system to visual and sound stimuli which simulate a real world experience. Typically, a virtual reality system further includes one or more input devices and interface software so that the user of the system can interact with the virtual environment that is being recreated, such as to simulate the user movement in the environment or manipulation of virtual objects reproduced in the virtual environment.

Virtual reality systems in the prior art have been used for entertainment purposes, to conduct scientific experiments, or to allow a user to indirectly carry out tasks which would otherwise be too difficult or dangerous when conducted in a real environment.

To a lesser extent, virtual reality systems have been used to create and control a virtual world that responds to music signals or to pre-recorded control tracks corresponding to music signals. Such a system is disclosed in U.S. Pat. No. 5,513,129, which describes a virtual reality in which a music source is connected to an electronic interface and to a virtual reality processor. The system is further controlled by one or more input devices, such as a head tracker and manipulator glove. The pre-recorded music, along with an optional pre-recorded control track, controls and manipulates objects within the virtual environment such that the music effectively drives the display of an animated graphical scene. However, the system described in U.S. Pat. No. 5,513,129 does not provide a simple and effective method for allowing a musician to participate in and control a "virtual environment" through the actual operation of a musical instrument, such as an electric guitar. Such a system would provide a source of entertainment to professional and amateur musicians alike. It also would assist musical instrument manufacturers in promoting the sale of their instruments by allowing a prospective purchaser to recreate a musical concert, to simulate the musician's participation in the concert, and to control the sound portion of the concert through operation of the guitar or other instrument. Preferably, such a simulation system would minimize the use of complex and expensive hardware and software so that the system would be easy to set up and affordable even at the retail store level. Such a system is lacking in the prior art.

SUMMARY OF THE INVENTION

In the simulation and control system of the present invention, the video and sound portions of a musical performance or concert is pre-recorded on a video tape, digital disc, or other media containing audio and video tracks. The sound portion of the concert will include a separate instrument track representing musical sounds that would be made during the pre-recorded concert by a specific musical instrument. The tape or disc containing the prerecorded video and sound tracks is loaded into a conventional video disc or video tape player. The video output from the video player is connected to a video display, such as a stereoscopic headset. The audio output of the video player is connected to left and right audio inputs on a multi-channel audio mixer. Means are provided in the mixer or in a decoder to separate the pre-recorded instrument sound track from the left and right concert sound tracks containing music from the other concert instruments as well as ambient crowd and backstage noise. The separated instrument sound track is then available for control by other system hardware.

A musical instrument corresponding to the specific musical instrument represented by the pre-recorded instrument sound track has its audio output connected to an instrument input on a system interface box. The interface box also includes an instrument track audio input connected to an output on the mixer, with a controlled instrument track audio output from the interface box connected to a separate audio input on the mixer.

The interface box includes an instrument track control circuit which electronically varies an electrical characteristic or parameter of the instrument track audio, such as the audio level. The instrument track control circuit in the interface box is responsive to the instrument audio signals received at the instrument audio input on the interface box. Accordingly, the playing of the musical instrument by the musician will control or vary the sound level of the instrument track provided to the mixer. The mixer combines the controlled instrument soundtrack with the left and right concert sound tracks, and provides the mixed audio to a mixer output connected to the speakers on the headset. The musician can then cause the system to vary the volume level of the instrument track in response to playing of the musical instrument.

In a further embodiment of the system, the interface box includes a bypass circuit controlled by an external switch. For a normal system mode, only the controlled instrument sound track is provided to the mixer and therefore to the headset. In a bypass mode, as selected by the switch, the bypass circuit causes the interface box to suppress the instrument sound track and to provide the audio signals produced by the instrument directly to the mixer. In this bypass mode, then, the musician can hear himself play the instrument in synchronization with the concert video track and the left and right concert sound tracks, thereby enhancing the level of simulated participation. Preferably, the video portion of the pre-recorded concert is filmed as if "through the eyes" of an onstage musician so that the user of the system can assume that role while playing the instrument.

DESCRIPTION OF THE PREFERRED EMBODIMENTS

Figure 1:
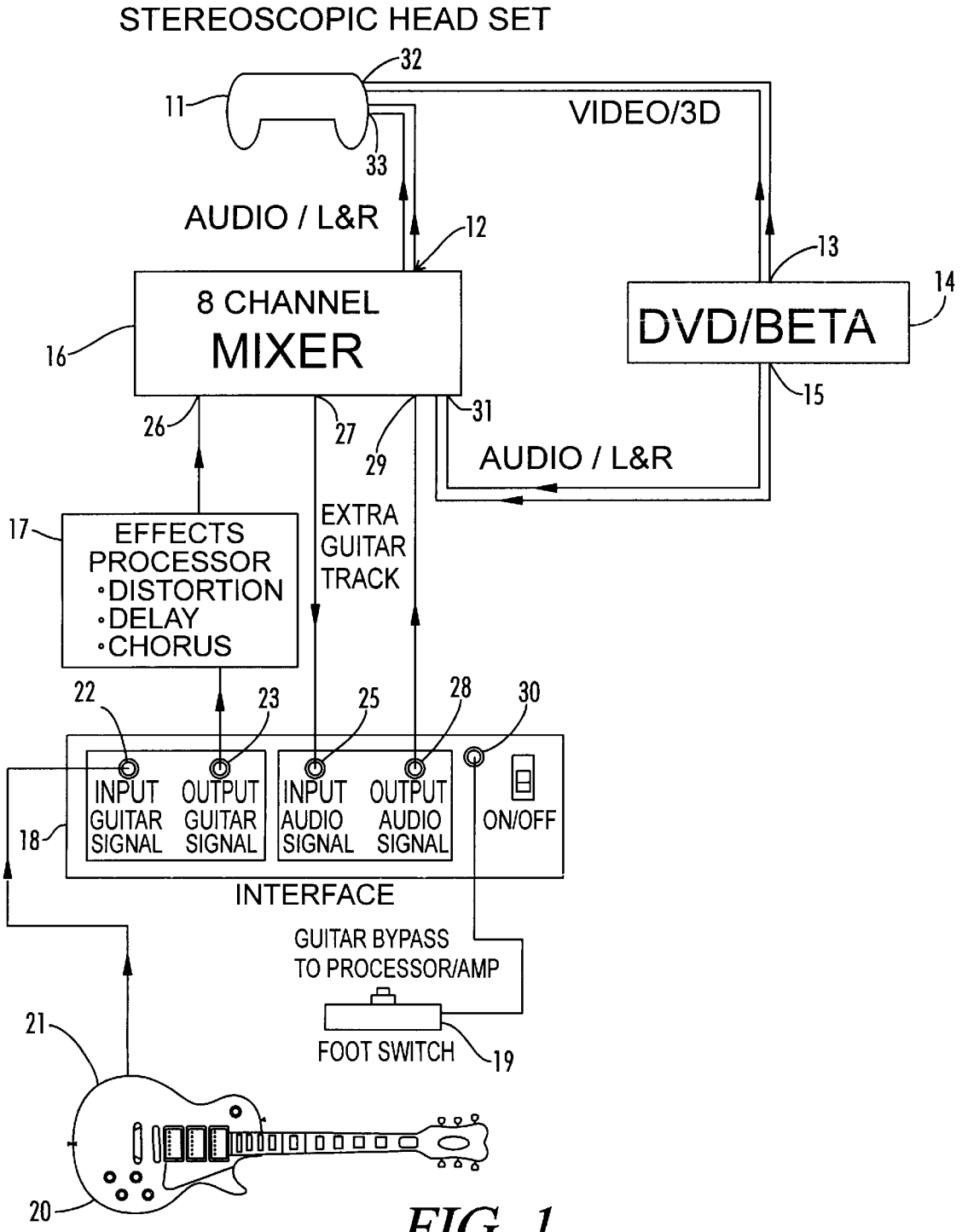
FIG. 1 is a block diagram of the simulation control system of the present invention.

The concert simulation and control system 10 is shown generally in FIG. 1. A musical instrument, such as a guitar 20, having one or more pick-ups or other transducers that will generate electrical audio signals, when the guitar is played, at an instrument audio output 21. Instrument audio output 21 is electrically connected to an instrument input 22 on a system interface box 18. Interface box 18 includes an instrument audio output 23 which, as will be described below, can be switched to provide a direct electrical connection to instrument input 22.

In one embodiment of system 10, where the musical instrument is guitar 20, a musical effects processor 17 is electrically connected between instrument audio output 23 on interface box 18 and a corresponding mixer instrument input 26 on a multi-channel audio mixer 16. Effects processor 17 is of conventional design and will typically include electronically induced distortion, delay, and other special effects which electrically modify the audio signals generated by guitar 20.

The audio mixer 16 is also of conventional design and in one embodiment, will have eight audio channels. A pair of left and right source audio inputs 31 on mixer 16 are electrically connected to corresponding left and right source audio outputs 15 on an audio video ("AV") playback device 14. AV playback device 14 is also of conventional design, and can be a video tape player or DVD player. Accordingly, AV player 14 will also have a source video output 13 electrically connected to a video input 32 on a video display device, such as the video stereoscopic headset 11. Preferably, headset 11 will be a conventional head mounted display wearable by the player of guitar 20. Headset 11 will include left and right speakers driven by a pair of left and right headset audio inputs 33 which are electrically connected to corresponding left and right mixer audio outputs 12 on mixer 16. Three-dimensional viewing of the concert video is enabled by conventional 3D shutter glasses (not shown) inside the headset. A commercially available headset usable in this application is the Model CE200-W Cyber Eye headset from General Reality Company, San Jose, Calif.

The audio portion of the pre-recorded musical concert to be played back by AV player 14 will include left and right concert sound tracks and a separable instrument sound track, all of which are electrically transmitted to mixer 16. Mixer 16 can include conventional circuits capable of electronically separating the instrument sound track from the left and right concert sound tracks. Otherwise, the tracks are separated externally by AV player 14 or by an external decoder and provided to mixer 16 through discrete inputs. Accordingly, mixer 16 will further include an instrument track mixer output 27 electrically connected to an instrument track interface input 25 on interface box 18. In accordance with the novel control system and method of this invention, and as will be described further below, interface box 18 will preferably include a controlled instrument track audio output 28 electrically connected to input 29 on mixer 16. Mixer 16 can then, in conventional fashion well known to those of skill in the art, combine and mix the left and right concert sound tracks provided at input 31 by AV player 14 with the controlled instrument sound track provided at input 29, and output the mixed audio signal to the headset 11 at mixer audio output 12.

Interface box 18 can also include a switch input 30 electrically connected to an external switch 19 operable by the musician playing guitar 20. In conjunction with the bypass and control circuits of system interface box 18 as illustrated in FIG. 2 and described below, switch 19 will place interface box 18 in either a normal or bypass mode, allowing the musician to select from at least two different simulation modes available on system 10.

Figure 2:
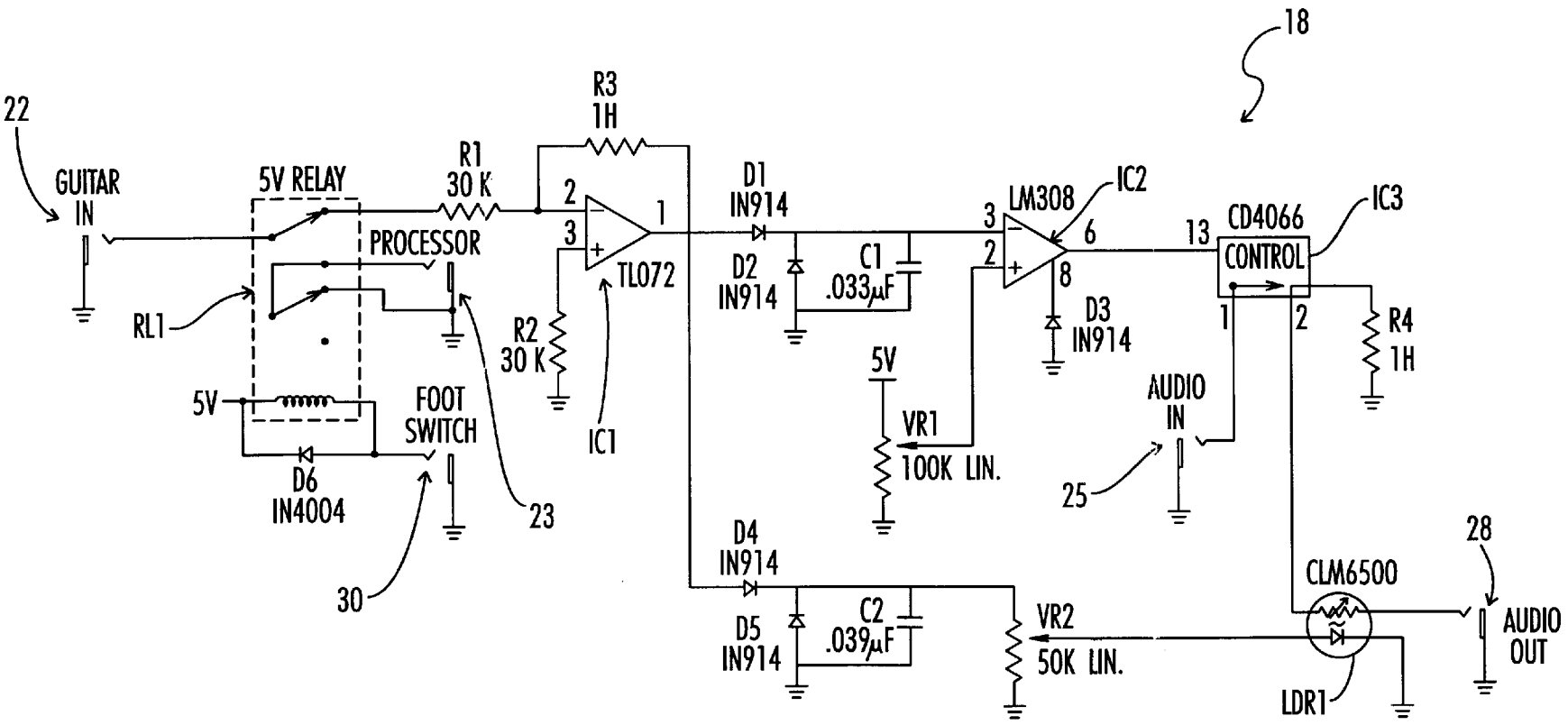
FIG. 2 is a schematic diagram of the system interface box used in the system of FIG. 1.

One embodiment of the system interface box 18 is shown schematically in FIG. 2. The instrument input 22 is electrically connected to a relay RL1. Relay RL1 has a "normal" position in which it will cause the instrument audio output 21 to be electrically connected to the inverting input (pin 2) of operation amplifier IC1, through resistor R1. Relay RL1 can be switched to a "bypass" mode whereby the instrument audio output 21 is electrically connected directly to instrument audio output 23 on interface box 18. Relay RL1 is caused to switch from the normal mode to the bypass mode by activation of switch 19 connected to interface box 18 at switch input 30. Preferably, switch 19 is a foot operated switch so that the musician can change the system mode while simultaneously playing guitar 20 with both hands.

When the system 10 and bypass circuit 18 are in the normal mode, the instrument audio signals are amplified by IC1 in a conventional manner, with the gain set by resistors R3 and R1. The audio signals at the output of amplifier IC1 are rectified by diodes Dl and D2. The ripple in the output signal from amplifier IC1 is reduced by capacitor C1, so that the output is a substantially DC voltage having a magnitude that corresponds to variations in the average peak magnitude of the audio signals from guitar 20. The rectified signal is applied to one input of an analog comparator IC2. The output of comparator IC2 is either "high" or "low" depending upon the relationship between the voltage at terminal 3 of IC2 and the voltage at terminal 2. The voltage at terminal 2 of IC2 is a comparator threshold set in conventional manner by potentiometer VR1 connected to a nominal five volt supply voltage. The output of comparator IC2 controls an electronic switch IC3, which can be a conventional CMOS switch, such as a type CD4066 available from National Semiconductor.

Electronic switch IC3 performs the function of switching instrument track input 25 on interface box 18 into the control circuit of interface box 18 such that the instrument sound track audio is electrically connected to controlled instrument track output 28 through a control device LDR1. Control device LDR1 can be any conventional signal conditioning device, such as an amplifier or an active or passive attenuator. In the embodiment of FIG. 2, control device LDR1 is a light dependent resistor, such as the type CLM5500 available from Javenco Electronics Supply. Accordingly, the instrument sound track audio signals are attenuated by a resistive portion of control device LDR1, which is varied by the output from a light emitting portion. Thus, control device LDR1 includes a light emitting diode having a control input driven by the output of amplifier IC1. Again, the output of amplifier IC1 is rectified by diodes D4 and D5, with the rectified signal further smoothed by capacitor C2, such that the variable DC voltage is applied across potentiometer VR2. Accordingly, as the RMS or average signal level or magnitude of the instrument audio signal increases, the voltage across potentiometer VR2 will proportionally increase, thereby increasing the current through the LED portion of control device LDR1. This decreases the attenuation provided by control device LDR1 of the instrument sound track audio between instrument sound track audio input 25 and controlled instrument sound track audio output 28. Using such a control circuit, then, and when the system 10 is in the normal mode, the musician will hear the pre-recorded instrument sound track on the headset at a volume that varies in proportion to how hard or how soft the musician is striking the strings of guitar 20. This control effect provides a simulation of the musician actually participating as a player of the instrument in the pre-recorded musical concert.

In a further embodiment of system 10, an additional switch output can be provided on switch IC3 and connected to a control input on AV player 14, such that generation of instrument audio signals by playing of the guitar 20 will activate playback of the pre-recorded musical concert from AV player 14.

In yet another embodiment of the system 10 in which AV player 14 is a DVD player, having a conventional PCM/AC-3 digital audio output at source audio output 15, a Dolby Digital Decoder can be placed in the audio circuit between source audio output 15 and mixer source audio input 31, to digitally separate the pre-recorded instrument sound track from the pre-recorded left and right concert sound tracks.

Although system 10 is shown and described for use with an electric or amplified acoustic guitar, it can be used with a variety of other musical instruments which either directly, or indirectly through an interface device, will produce electrical audio signals representative of the sounds made by the instrument.

Also, in the embodiment of system 10 as described and shown, the characteristic of the pre-recorded instrument sound track that is controlled by the control circuit in interface box 18 is the signal level or magnitude of the audio. However, by changing the nature of the control circuit, different parameters of the instrument sound track audio can be varied in response to operation of the musical instrument. For example, a controllable analog or digital audio filter could be substituted for the light dependent resistor shown in FIG. 2, whereby the frequency response of the filter will vary in accordance with the voltage across potentiometer VR2, thereby changing the frequency or tonal characteristics of the instrument audio track as the guitar 20 is played.

In many applications, a wearable stereoscopic headset with left and right speakers is an ideal combination of a video display and audio transducer to be used with system 10. However, in other applications, a two dimensional video display can be used, either wearable or not, in conjunction with floor or wall mounted audio speakers. Or, multiple audio and video playback and display systems can be used in parallel.

Generally, the pre-recorded musical concert will be recorded on video using a stereoscopic camera to produce a "3D" playback effect, with simultaneous audio recording of the concert sound tracks and, usually, the instrument sound track. Other backstage footage can be included to simulate the musician's participation in pre-concert preparation and build-up. To further create the virtual concert experience, additional backstage and onstage audio can be recorded, either during filming of the actual musical performance or later in the studio. The separate instrument sound track can be recorded live in conjunction with the video and other audio portions of the musical concert or can be added later or re-mixed in the studio. If the system 10 is to be used by an instrument manufacturer to promote the sale of its products, suitable marketing and promotional logos and messages can be superimposed over the concert video and/or audio while the system is in operation. To this end, the pre-recorded video can include a segment where the musician is shown selecting a specific manufacturer's instrument to play on stage.

One advantage of this system is that no computer is needed to operate or control it. If a DVD player is used for AV player 14, multiple pre-recorded concert segments can be placed on the disc, allowing the user of the system to easily switch to other programs (a jazz club, a country music festival, etc.), representing a favorite experience, venue or band.

Thus, although there have been described particular embodiments of the present invention of a new System and Method for Generating and Controlling a Simulated Musical Concert Experience, it is not intended that such references be construed as limitations upon the scope of this invention except as set forth in the following claims.

What is claimed is:

1. A system for electronically simulating participation by a user in a pre-recorded musical performance comprising:

a. a musical instrument, the musical instrument generating an instrument audio signal at an instrument audio output, the instrument audio signal varying in response to operation of the instrument by the user of the system;

b. a video source providing a source video signal at a source video output, the source video signal representing a video portion of the pre-recorded musical performance;

c. a video display responsive to the source video signal whereby the user can view the video portion of the pre-recorded musical performance on the video display;

d. an audio source providing a source audio signal at a source audio output, the source audio signal representing an audio portion of the pre-recorded musical performance, the audio portion including an instrument sound track containing pre-recorded musical sounds that would be generated by the musical instrument in the pre-recorded musical performance;

e. a system interface device having a first audio input electrically connected to the instrument audio output, a second audio input electrically connected to the source audio output, and a first interface audio output;

f. the system interface device including a source audio control circuit responsive to the instrument audio signal, whereby a characteristic of the source audio signal is controlled in response to operation of the musical instrument by the user to provide a controlled source audio signal at the first interface audio output; and g. an audio playback transducer responsive to the controlled source audio signal such that the user can listen to the audio portion of the pre-recorded musical performance on the transducer, in synchronization with the video portion.

2. The system of claim 1 whereby the characteristic of the source audio signal controlled by the source audio control circuit is a source audio signal level.

3. The system of claim 2 wherein the musical instrument is a guitar whereby variations in striking of strings on the guitar by the user produces changes in level of the audio portion of the pre-recorded musical performance on the audio playback transducer.

4. The system of claim 1 wherein the system interface device further comprises an instrument audio switch responsive to the instrument audio signal level to connect the controlled source audio signal to the interface audio output only when the instrument audio signal level reaches a pre-determined threshold generated by operation of the musical instrument.

5. The system of claim 4 further comprising a bypass switch operable when switched to a bypass position to connect the instrument audio signal to the audio transducer such that the user can listen to the instrument audio signal while operating the musical instrument and while viewing the video portion of the musical performance.

6. The system of claim 5 wherein the system interface device is further operable to suppress the instrument audio track when the bypass switch is in the bypass position.

7. The system of claim 1 further comprising an audio mixer operably connected between the interface audio output and the audio transducer.

8. The system of claim 7 wherein the audio mixer is further operably connected between the source audio output and the first audio input on the interface device.

9. The system of claim 8 further comprising an audio effects processor operably connected between the system interface device and the audio mixer.

10. The system of claim 1 wherein the audio source and the video source are combined in a video tape machine.

11. The system of claim 1 wherein the audio source and the video source are combined in a video disc machine.

12. The system of either claim 10 or claim 11 wherein the video display and the audio playback transducer are combined in a stereoscopic head set wearable by the user.

13. A system for simulating participation of a user playing a musical instrument in a pre-recorded musical performance having audio and video portions, the musical instrument producing instrument audio signals at an instrument audio output when the instrument is played, comprising:

a. a source playback device for playback of the audio and video portions of the pre-recorded musical performance through corresponding source audio and source video outputs;

b. a source audio control device for controlling one or more characteristics of the audio portion of the pre-recorded musical performance during playback, the source audio control means operably connected to the source audio output and to the instrument audio output and having a controlled audio output; and c. the source audio control device is responsive to the instrument audio signals whereby at least one characteristic of the audio portion of the pre-recorded musical performance is controlled by playing of the musical instrument by the user.

14. The system of claim 13 wherein the audio portion of the pre-recorded musical performance comprises a separate instrument sound track and whereby the characteristic of the audio portion controlled by the source audio control circuit is a volume level of the instrument sound track played by the system.

15. The system of claim 14 wherein the musical instrument is a guitar and wherein the instrument sound track comprises pre-recorded guitar music such that the volume level of the pre-recorded guitar music played by the system is controlled by playing of the guitar by the user.

16. The system of claim 15 further comprising a bypass switch operable by the user to suppress the instrument audio track and to cause the instrument audio signals to be played by the system when the user plays the guitar in synchronization with video portion of the pre-recorded musical performance.

17. The system of claim 16 wherein the audio portion of the pre-recorded musical performance further comprises a performance audio track separable from the instrument audio track such that the volume level of the pre-recorded guitar music is controlled independently of the performance audio track.

18. The system of claim 13 further wherein the source audio control device is further operable to cause initial activation of the source playback device in response to playing of the guitar by the user.

19. The system of claim 13 further comprising a headset wearable by the user, the headset having left and right audio speakers and a stereoscopic video display, the left and right speakers operably connected to left and right channels on the source audio output and to the controlled audio output, and the video display operably connected to the source video output.

20. The system of claim 13 further comprising an audio mixer, the mixer operably connected between the source audio, instrument audio, and controlled audio outputs and the left and right speakers.

21. A system for allowing a player using a guitar to control simulated participation in a musical concert during synchronous playback of a pre-recorded concert video track, pre-recorded left and right concert sound tracks, and a separate pre-recorded guitar track, the system comprising:

a. an audio/video playback device adapted to play the pre-recorded video track through a video source output in synchronization with playback of the pre-recorded left and right concert sound tracks through left and right channel source outputs and the pre-recorded guitar track through a guitar track source output;

b. a video display connected to the video source output;

c. an audio interface box having an instrument input connected to an instrument output on the guitar, an instrument audio output, a guitar track input, and a controlled guitar track output;

d. an audio mixer having a mixer source input connected to the left and right channel source outputs and to the guitar track source output, a mixer instrument input connected to the instrument audio output, a guitar track output connected to the guitar track input on the interface box and adapted to output the pre-recorded guitar track, a controlled guitar track input connected to the controlled guitar track output; and a mixer audio output having right and left channels, the mixer audio output providing a system audio signal responsive to instrument audio signals at the mixer instrument input, to the guitar track, and to the left and right sound tracks;

e. left and right audio speakers connected to respective left and right channels of the mixer audio output;

f. the interface box further comprising a guitar channel control circuit operable to control a signal level of the guitar track at the controlled guitar track output in response to variation in instrument audio signals generated at the instrument audio output when the guitar is played; and g. whereby the player can hear the left and right pre-recorded concert sound tracks and the guitar track while viewing the video track and can control a sound volume of the guitar track by playing the guitar.

22. The system of claim 21 further comprising a bypass switch connected to a switch input on the interface box, the interface box further including a bypass circuit responsive to the bypass switch and operable to inhibit output of instrument audio signals to the mixer when the bypass switch is in a normal position, and operable to inhibit output of the pre-recorded guitar track to the mixer when the bypass switch is in a bypass position, whereby the player can selectably play and hear the guitar in synchronization with the left and right concert sound tracks and with the concert video track.

23. The system of claim 21 further comprising an effects processor connected between the instrument audio output and the mixer instrument input.

24. The system of claim 21 wherein the left and right audio speakers and the video display are combined in a headset wearable by the guitar player.

25. A method of a simulating participation by a musician in a recorded concert comprising the steps of a. playing on a playback device a pre-recorded concert video track in synchronization with a pre-recorded concert sound track and a pre-recorded instrument sound track;

b. separating the instrument sound track from the concert sound track and providing the separated instrument sound track to a control device;

c. varying in the control circuit at least one parameter of the instrument sound track in response to audio signals generated by a musical instrument when played by the musician, thereby generating a controlled instrument sound track; and d. providing a normal simulation mode in which the controlled instrument sound track and the concert sound track are played on a sound system in synchronization with display of the concert video track.

26. The method of claim 25 further comprising the step of providing a bypass simulation mode in which the pre-recorded instrument track is suppressed and the audio signals generated by the musical instrument while the musician plays the instrument are played on the sound system in synchronization with the concert sound track and with display of the concert video.

27. The method of claim 26 wherein the musical instrument is a guitar.

28. An apparatus for controlling playback from a playback device of a pre-recorded instrument sound track in synchronization with a pre-recorded concert sound track and a pre-recorded concert video track comprising:

a. a musical instrument having an instrument audio output;

b. a control circuit connected to the instrument audio output and to the playback device; and c. the control circuit comprising an instrument track input connected to an instrument track output through a signal conditioning circuit, the signal conditioning circuit responsive to audio signals generated by the musical instrument when the instrument is played whereby the control circuit generates a controlled instrument track signal at the instrument track output.

29. The apparatus of claim 28 further comprising a bypass circuit controlled by a bypass switch and operatively connected to the control circuit, the switch having a bypass position in which the bypass circuit inhibits generation of the controlled instrument track signal and allows audio reproduction of the audio signals generated by the musical instrument during playback of video track and the concert sound track.

30. The apparatus of claim 29 wherein the musical instrument is a guitar and wherein the pre-recorded instrument track comprises guitar music.

* * * * *

US005990405C1

(12) EX PARTE REEXAMINATION CERTIFICATE (7199th)

United States Patent
Auten et al.

(10) Number: US 5,990,405 C1
(45) Certificate Issued: Dec. 1, 2009

(54) SYSTEM AND METHOD FOR GENERATING AND CONTROLLING A SIMULATED MUSICAL CONCERT EXPERIENCE

(75) Inventors: Don R. Auten, Nashville, TN (US); Richard T. Akers, Antioch, TN (US); Richard Gembar, Mt. Juliet, TN (US)

(73) Assignee: Lasalle Bank National Association, Chicago, IL (US)

Reexamination Request:
No. 90/009,128, Apr. 24, 2008

Reexamination Certificate for:

| | |
|---|---|
| Patent No.: | **5,990,405** |
| Issued: | **Nov. 23, 1999** |
| Appl. No.: | **09/112,050** |
| Filed: | **Jul. 8, 1998** |

(51) Int. Cl.

| | |
|---|---|
| ***G10H 1/36*** | (2006.01) |
| ***G10H 3/18*** | (2006.01) |
| ***G10H 3/00*** | (2006.01) |

(52) U.S. Cl. ..... 84/609; 84/610; 84/634; 84/649; 84/650

(58) Field of Classification Search ..... None
See application file for complete search history.

(56) References Cited

U.S. PATENT DOCUMENTS 4,310,849 A * 1/1982 Glass ..... 348/53
4,677,890 A * 7/1987 Yannes ..... 84/661
5,488,196 A 1/1996 Zimmerman et al.
5,491,297 A 2/1996 Johnson et al.
5,739,457 A 4/1998 Devecka

OTHER PUBLICATIONS

*Activision Publ'g, Inc.* v. *Gibson Guitar Corp.*, No. 08–1653, Central District of California, Claim Construction For Claim Terms "Musical Instrument" and "Instrument Audio Signal" dated Sep. 16, 2008.
"Virtual Guitar Adds Realism to Musical Fantasies", Washington Post Article by Paul De Groot; Jan. 20, 1995 (3 Pages).
"Quest for Fame", Virtual Music Help document (including Quest for Fame software packaging and CD–ROMs) (54 pgs.).

* cited by examiner

*Primary Examiner*—Anjan K. Deb

(57) ABSTRACT

A musician can simulate participation in a concert by playing a musical instrument and wearing a head-mounted 3D display that includes stereo speakers. Audio and video portions of a musical concert are pre-recorded, along with a separate sound track corresponding to the musical instrument played by the musician. Playback of the instrument sound track is controlled by signals generated in the musical instrument and transmitted to a system interface box connected to the audio-video play back device, an audio mixer, and the head-mounted display. An external bypass switch allows the musician to suppress the instrument sound track so that the sounds created by actual playing of the musical instrument are heard along with the pre-recorded audio and video portions.

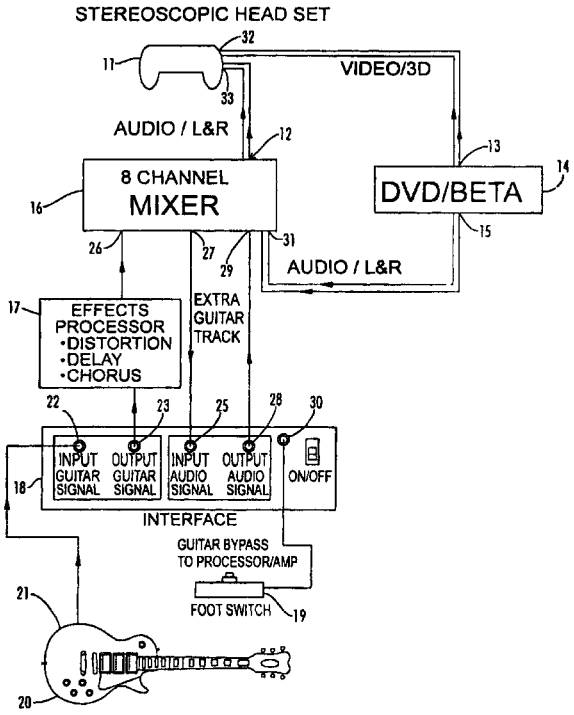

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 21, 23 and 24 are cancelled.

Claims 1, 13, 18, 22, 25, 26, 28, 29 are determined to be patentable as amended.

Claims 2–12, 14–17, 19, 20, 27 and 30, dependent on an amended claim, are determined to be patentable.

New claims 31–46 are added and determined to be patentable.

1. A system for electronically simulating participation by a user in a pre-recorded musical performance comprising:

a. a musical instrument [the musical instrument] *adapted for* (*i*) *making musical sounds and* (*ii*) generating an instrument audio signal *representative of the musical sounds* at an instrument audio output, the instrument audio signal [varying] *comprising an electrical signal output by the musical instrument that varies* in response to operation of the instrument by the user of the system;

b. a video source providing a source video signal at a source video output, the source video signal representing a video portion of the pre-recorded musical performance;

c. a video display responsive to the source video signal whereby the user can view the video portion of the pre-recorded musical performance on the video display;

d. an audio source providing a source audio signal at a source audio output, the source audio signal representing an audio portion of the pre-recorded musical performance, the audio portion including an instrument sound track containing pre-recorded musical sounds that would be generated by the musical instrument in the pre-recorded musical performance;

e. a system interface device having a first audio input electrically connected to the instrument audio output, a second audio input electrically connected to the source audio output, and a first interface audio output;

f. the system interface device including a source audio control circuit responsive to the instrument audio signal, whereby a characteristic of the source audio signal is controlled in response to operation of the musical instrument by the user to provide a controlled source audio signal at the first interface audio output; and g. an audio playback transducer responsive to the controlled source audio signal such that the user can listen to the audio portion of the pre-recorded musical performance on the transducer, in synchronization with the video portion.

13. A system for simulating participation of a user playing a musical instrument in a pre-recorded musical performance having audio and video portions, the musical instrument *adapted for* (*i*) *making musical sounds and* (*ii*) producing *electrical* instrument audio signals *representative of the musical sounds* at an instrument audio output when the instrument is played, comprising:

a. a source playback device for playback of the audio and video portions of the pre-recorded musical performance through corresponding source audio and source video outputs;

b. a source audio control device for controlling one or more characteristics of the audio portion of the pre-recorded musical performance during playback, the source audio control means operably connected to the source audio output and to the instrument audio output and having a controlled audio output; and c. the source audio control device is responsive to the isntrument audio signals whereby at least one characteristic of the audio portion of the pre-recorded musical performance is controlled by playing of the musical instrument by the user.

18. The system of claim 13, further wherein the source audio control device is further operable to cause initial activation of the source playback device in response to playing of the [guitar] *musical instrument* by the user.

22.[The system of claim 21 further comprising] *A system for allowing a player using a guitar to control simulated participation in a musical concert during synchronous playback of a pre-recoreded concert video track, pre-recorded left and right concert sound tracks, and a separate pre-recorded guitar track, the system comprising:*

*an audio/video playback device adapted to play the pre-recorded video track through a video source output in synchronization with playback of the pre-recorded left and right concert sound tracks through left and right channel source outputs and the pre-recorded guitar track through a guitar track source output;*

*a video display connected to the video source output;*

*an audio interface box having an instrument input connected to an instrument output on the guitar, an instrument audio output, a guitar track input, and a controlled guitar track output;*

*an audio mixer having a mixer source input connected to the left and right channel source outputs and to the guitar track source output, a mixer instrument input connected to the instrument audio output, a guitar track output connected to the guitar track input on the interface box and adapted to output the pre-recoreded guitar track, a controlled guitar track input connected to the controlled guitar track output; and a mixer audio output having right and left channels, the mixer audio output providing a system audio signal responsive to instrument audio signals at the mixer instrument input, to the guitar track, and to the left and right sound tracks;*

*left and right audio speakers connected to respective left and right channels of the mixer audio output;*

*the interface box further comprising a guitar channel control circuit operable to control a signal level of the guitar track at the controlled guitar track output in response to variation in the instrument audio signals generated at the instrument audio output when the guitar is played;*

*whereby the player can hear the left and right pre-recorded concert sound tracks and the guitar track*

*while viewing the video track and can control a sound volume of the guitar track by playing the guitar; and* a bypass switch connected to a switch input on the interface box, the interface box further including a bypass circuit responsive to the bypass switch and operable to inhibit output of *the* instrument audio signals to the mixer when the bypass switch is in a normal position, and operable to inhibit output of the pre-recorded guitar track to the mixer when the bypass switch is in a bypass position, whereby the player can selectably play and hear the guitar in synchronization with the left and right concert sound tracks and with the concert video track.

25. A method of a simulating participation by a musician in a recorded concert comprising the steps of a. playing on a playback device a pre-recorded concert video track in synchronization with a pre-recorded concert sound track and a pre-recorded instrument sound track;

b. separating the instrument sound track from the concert sound track and providing the separated instrument sound track to a control device;

c. varying in the control circuit at least one parameter of the instrument sound track in response to *electrical instrument* audio signals generated by a musical instrument when played by the musician, *wherein* (*i*) *the musical instrument is adapted for making musical sounds and* (*ii*) *the electrical instrument audio signals are representative of the musical sounds*, thereby generating a controlled instrument sound track; and d. providng a normal simulation mode in which the controlled instrument sound track and the concert sound track are played on a sound system in synchronization with display of the concert video track.

26. [The method of claim 25 further comprising the step of] *A method of simulating participation by a musician in a recorded concert comprising the steps of:*

*a. playing on a playback device a pre-recorded concert video track in synchronization with a pre-recorded concert sound track and a pre-recorded instrument sound track;*

*b. separating the instrument sound track from the concert sound track and providing the separated instrument sound track to a control device;*

*c. varying in the control circuit at least one parameter of the instrument sound track in response to electrical instrument audio signals generated by a musical instrument when played by the musician, thereby generating a controlled instrument sound track;*

*d. providing a normal simulation mode in which the controlled instrument sound track and the concert sound track are played on a sound system in synchronization with display of the concert video track; and*

*e.* providing a bypass simulation mode in which the pre-recorded instrument track is suppressed and the *instrument* audio signals generated by the musical instrument while the musician plays the instrument are played on the sound system in synchronization with the concert sound track and with display of the concert video.

28. An apparatus for controlling playback from a playback device of a pre-recorded instrument sound track in synchronization with a pre-recorded concert sound track and a pre-recorded concert video track comprising:

a. a musical instrument (*i*) having an instrument audio output, (*ii*) *being adapted for making musical sounds, and* (*iii*) *being adapted for producing to the instrument audio output electrical instrument audio signals that are representative of the musical sounds*;

b. a control circuit connected to the instrument audio output and to the playback device; and c. the control circuit comprising an instrument track input connected to an instrument track output through a signal conditioning circuit, the signal conditioning circuit responsive to *the electrical instrument* audio signals generated by the musical instrument when the instrument is played whereby the control circuit generates a controlled instrument track signal at the instrument track output.

29. [The apparatus of claim 28 further comprising a bypass circuit controlled by] *An apparatus for controlling playback from a playback device of a pre-recorded instrument sound track in synchronization with a pre-recorded concert sound track and a pre-recorded concert video track comprising:*

*a musical instrument having an instrument audio output;*

*a control circuit connected to the instrument audio output and to the playback device;*

*the control circuit comprising an instrument track input connected to an instrument track output through a signal conditioning circuit, the signal conditioning circuit responsive to instrument audio signals generated by the musical instrument when the instrument is played whereby the control circuit generates a controlled instrument track signal at the instrument track onput; and* a bypass switch and operatively connected to the control circuit, the switch having a bypass position in which the bypass circuit inhibits generation of the controlled instrument track signal and allows audio reproduction of the *instrument* audio signals generated by the musical instrument during playback of video track and the concert sound track.

*31. The system of claim 1 wherein the musical instrument is an electric guitar.*

*32. The system of claim 1 wherein the musical instrument is an amplified acoustic guitar.*

*33. The system of claim 1 wherein the musical instrument is adapted for producing the instrument audio signal directly.*

*34. The system of claim 1 wherein the musical instrument is adapted for producing the instrument audio signal indirectly through an interface device.*

*35. The system of claim 13 wherein the musical instrument is an electric guitar.*

*36. The system of claim 13 wherein the musical instrument is an amplified acoustic guitar.*

*37. The system of claim 13 wherein the musical instrument is adapted for producing the instrument audio signals directly.*

*38. The system of claim 13 wherein the musical instrument is adapted for producing the instrument audio signals indirectly through an interface device.*

*39. The system of claim 25 wherein the musical instrument is an electric guitar.*

*40. The system of claim 25 wherein the musical instrument is an amplified acoustic guitar.*

*41. The system of claim 25 wherein the musical instrument is adapted for producing the instrument audio signals directly.*

*42. The system of claim 25 wherein the musical instrument is adapted for producing the instrument audio signals indirectly through an interface device.*

*43. The system of claim 28 wherein the musical instrument is an electric guitar.*

*44. The system of claim 28 wherein the musical instrument is an amplified acoustic guitar.*

*45. The system of claim 28 wherein the musical instrument is adapted for producing the instrument audio signals directly.*

*46. The system of claim 28 wherein the musical instrument is adapted for producing the instrument audio signals indirectly through an interface device.*

* * * * *